United States Patent [19]

Black, Jr.

[11] 4,151,807

[45] May 1, 1979

[54] CONTROL WHEEL FOR OUTBOARD ELECTRIC TROLLING MOTOR

[76] Inventor: Linville G. Black, Jr., 974 Palmer Rd., Memphis, Tenn. 38116

[21] Appl. No.: 821,767

[22] Filed: Aug. 4, 1977

[51] Int. Cl.[2] ..... B63H 25/00; B63H 21/26

[52] U.S. Cl. ..... 114/153; 74/481; 74/512; 115/18 R; 115/18 E

[58] Field of Search ..... 114/153, 144 R, 144 A, 114/146; 115/17, 18 R, 18 E, 18 A, 18 B, 41 R, 12 A, 70; 74/512, 515, 481; 9/1.3

[56] References Cited

U.S. PATENT DOCUMENTS

| | | | |
|---|---|---|---|
| 1,021,408 | 3/1912 | Haschke | 115/18 R |
| 2,720,185 | 10/1955 | Sever et al. | 115/18 R |
| 2,804,838 | 9/1957 | Moser | 114/153 |
| 2,988,037 | 6/1961 | Spencer | 114/153 |
| 3,013,518 | 12/1961 | Smith | 115/18 E |
| 3,119,365 | 1/1964 | Evans | 115/18 E |
| 3,599,168 | 8/1971 | Long | 115/18 E |
| 3,606,853 | 9/1971 | Edwards et al. | 115/18 R |
| 3,750,621 | 8/1973 | Hoyt | 115/18 R |
| 3,807,345 | 4/1974 | Peterson | 115/18 E |
| 3,995,579 | 12/1976 | Childre | 115/18 E |
| 4,040,375 | 8/1977 | Atkins et al. | 114/144 R |

FOREIGN PATENT DOCUMENTS

| | | | |
|---|---|---|---|
| 7336 of | 1914 | United Kingdom | 115/18 B |
| 254620 | 7/1926 | United Kingdom | 115/18 R |
| 1027385 | 4/1966 | United Kingdom | 9/1.3 |

*Primary Examiner*—Charles E. Frankfort

*Attorney, Agent, or Firm*—Hill, Van Santen, Steadman, Chiara & Simpson

[57] ABSTRACT

Any commercially-available, tiller-model electric outboard trolling motor, as for a bass boat, may be made easier and more convenient to steer by adding a control wheel about the vertical pivot shaft thereof for selective, continuous, eyes-off orientation by a user's foot or by a remotely-operated electric steering motor driving the wheel by its rim. A hub is mounted about the pivot shaft and the control wheel is rigidly joined to the hub, as by a plurality of spokes. The wheel and hub may be split for joining about the shaft without disassembly of the trolling motor head or propulsion unit from the shaft.

2 Claims, 7 Drawing Figures

Fig. 1
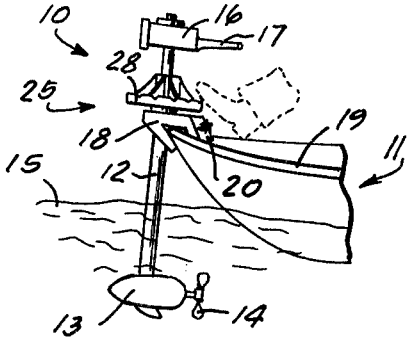
Fig. 3
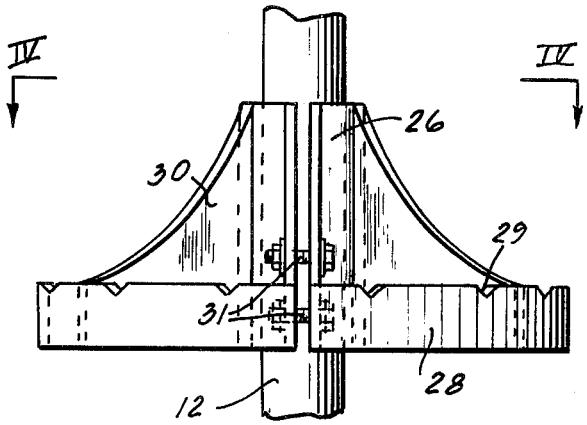
Fig. 2
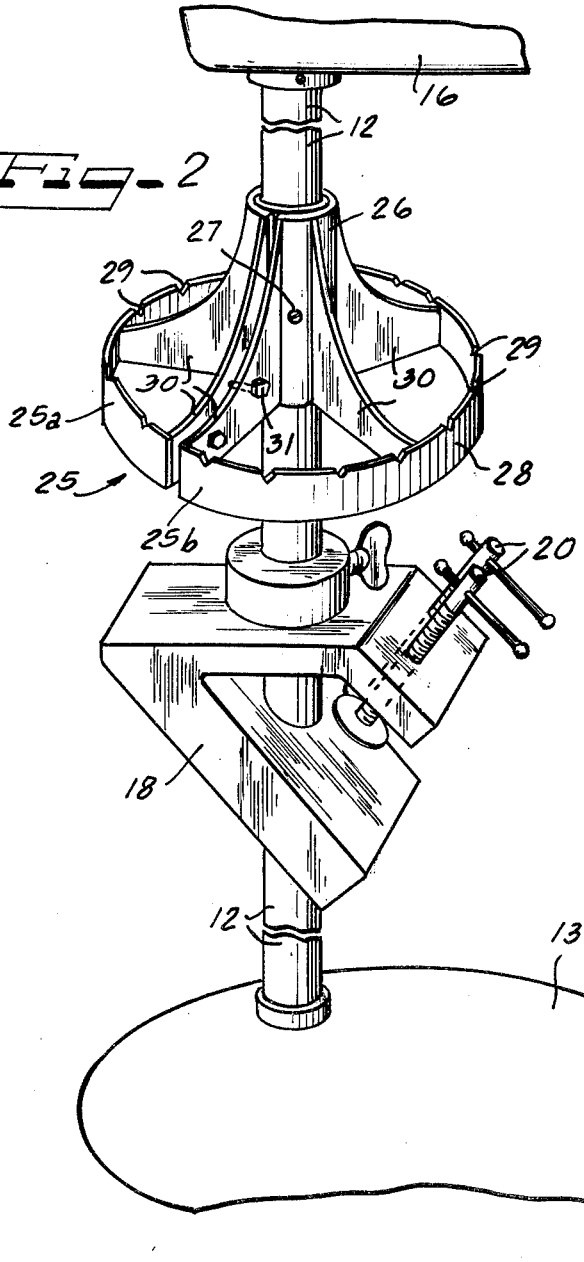
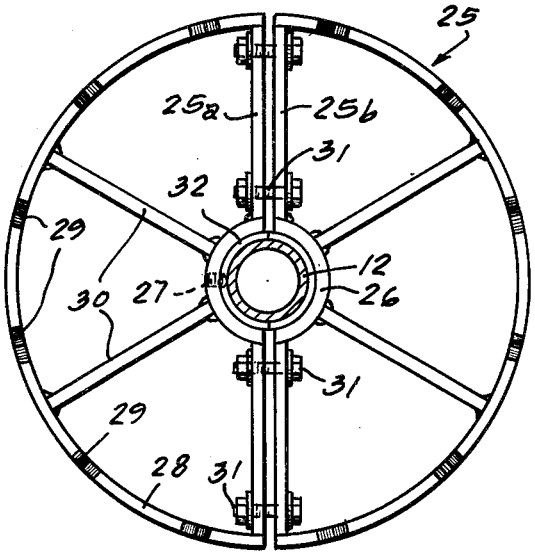
Fig. 4

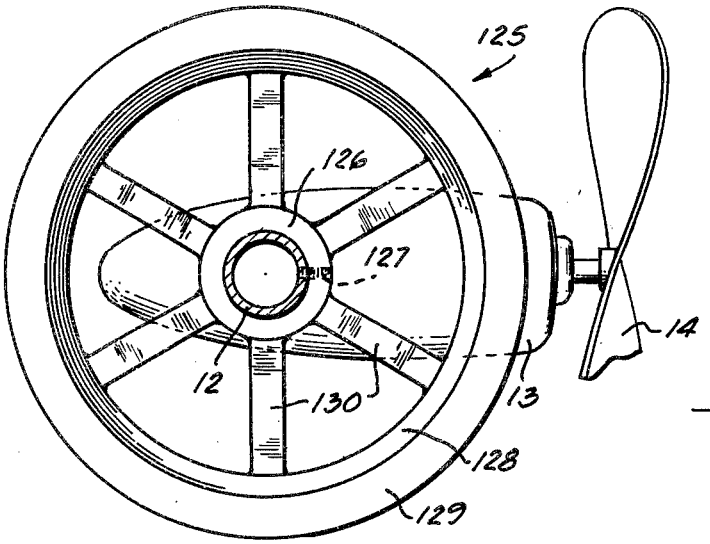
Fig-5
Fig-6
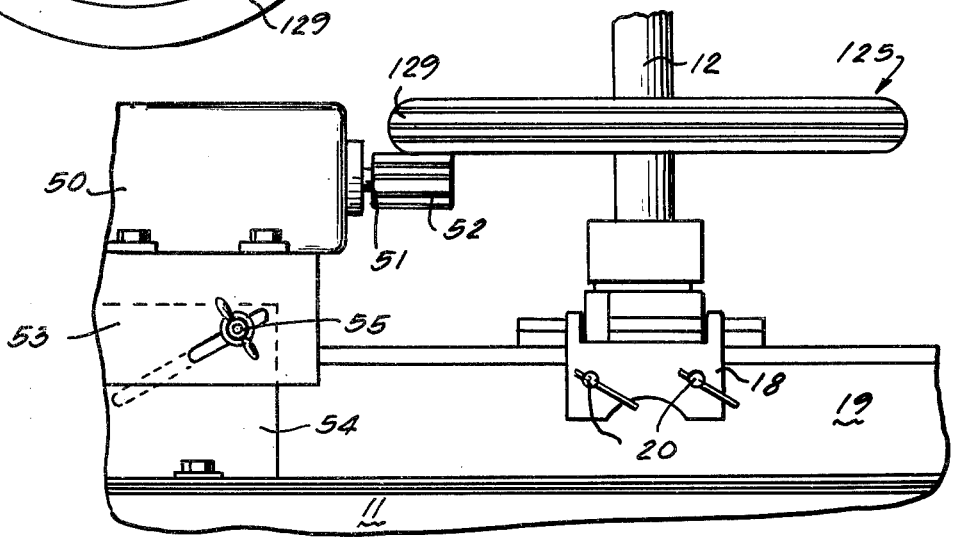
Fig-7
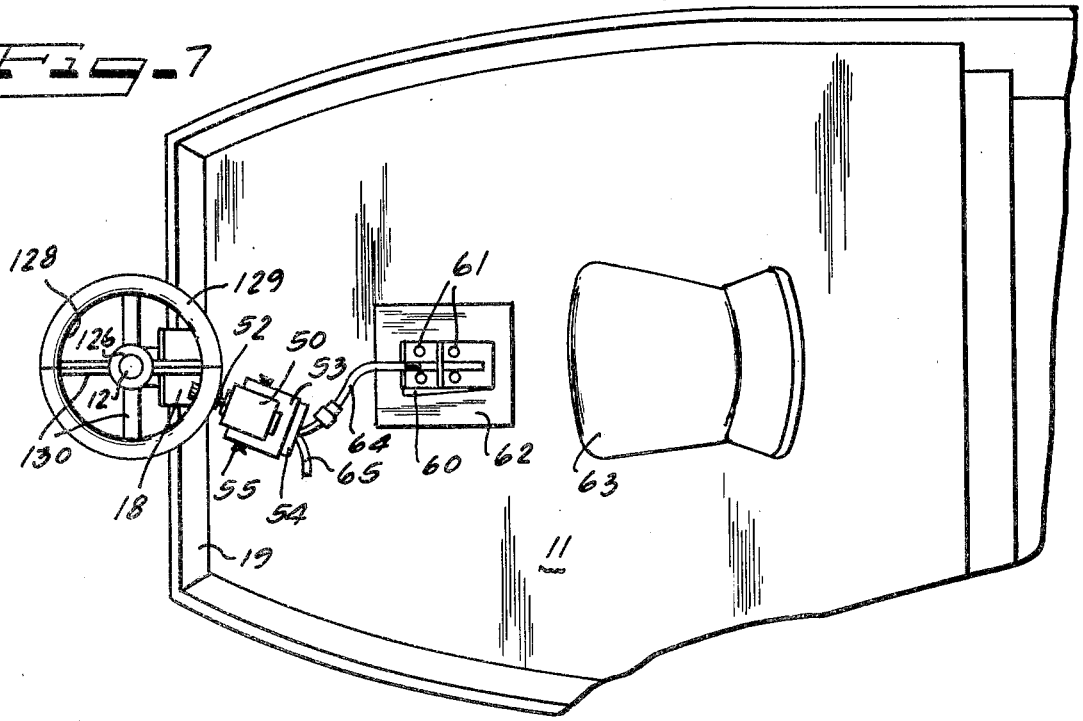

CONTROL WHEEL FOR OUTBOARD ELECTRIC TROLLING MOTOR

BACKGROUND OF THE INVENTION

1. Field of the Invention

The present invention relates to steering devices for outboard electric trolling motors.

2. The Prior Art

Outboard electric trolling motors have become widely used for low-speed maneuvering of small boats such as bass boats during fishing operations in protected waters. Such motors are typically mounted on the bow of a boat, having a submerged propulsion unit. The propulsion motor is driven electrically by a storage battery in the boat and is pivotable through 360° of rotation from straight ahead to reverse through either full left or full right steering movements.

Three types of steering controls have been adopted. Tiller models have the vertical pivot shaft retained snugly in a hinge bracket for reorientation only when the tiller handle is moved by the operator. Such motor will generally remain in whatever orientation it is left in. Often, a fisherman will kick the motor tiller with his foot to reorient the propulsion direction. Remote control, foot-operated motors use cables, rods, or other linkages to drive a drum, a rack and pinion, chain and sprocket, or similar device for orienting the submerged propulsion motor with respect to a fixed head of the motor assembly. By rocking a foot pedal fore and aft or from side to side, as in U.S. Pat. Nos. 3,511,208, 3,606,853, and 3,807,345, the operator can reorient the vertical shaft with respect to the boat. A third type of outboard motor steering control uses a remote electric drive, wherein an electric motor in the control head turns the pivot shaft through a series of reduction gears, a worm gear, a belt, or otherwise, as in U.S. Pat. No. 3,989,000. Such electric steering motor is less fatiguing for a fisherman to operate over a span of some hours, but gives him less feeling of control of this boat.

Add-on steering control devices have also been available, such as a rack and pinion-type plastic unit manufactured by the Pfleuger Company some years ago. An elbow rack device for adding to a tiller-model motor is disclosed in U.S. Pat. No. 3,750,621.

SUMMARY OF THE INVENTION

A full-rim wheel is affixed to the vertical shaft of a manually steered outboard electric trolling motor in a position drivable by either the foot of a user or a drive wheel of a remotely-controlled electric motor. The wheel is supported on a hollow hub and is affixed about the shaft either by sliding over an end of the disassembled trolling motor or by assembling same about the shaft from two halves.

THE DRAWINGS

FIG. 1 is a side elevational view of an outboard electric trolling motor employing the present invention.

FIG. 2 is a perspective view, partly broken away, of one embodiment of the invention.

FIG. 3 is a side elevational view of the control wheel of the invention.

FIG. 4 is a top plan view, taken on line IV—IV of FIG. 3.

FIG. 5 is a top plan view of a control wheel and shaft and propulsion motor of a second embodiment of the invention.

FIG. 6 is a front elevational view of a third embodiment of the invention, incorporating an electric drive.

FIG. 7 is a top plan view of the bow of a fishing boat fitted with the electric drive of FIG. 6.

THE PREFERRED EMBODIMENTS

An outboard electric trolling motor 10 is attached to the bow of a boat 11, as in FIG. 1. The trolling motor 10 comprises a vertical shaft 12 carrying on its lower end a propulsion motor 13 in a waterproof casing for driving a propeller 14 for developing thrust for guiding the boat 11 through a body of water 15. A control head 16 is carried on an upper end of the shaft 12 and carries a tiller handle 17. The tiller 17, control head 16, shaft 12, and motor 13 are affixed together irrotatably for movement about a vertical axis as a single unit. A motor mount 18 clamps to a gunwale 19 of the boat 11 at the bow thereof as by clamps 20. The mount 18 may, but need not, provide means for folding the trolling motor assembly 10 upwardly and onto the deck of the boat 11. The motor mount 18 engages the vertical shaft 12 with some friction, so that the shaft 12 will remain in whatever pivotal orientation it is left in by a user's grasping or kicking the tiller handle 17 during fishing operations.

In accordance with the principles of the invention, a control wheel 25 is fitted to the vertical shaft 12 of the fishing motor 10 between the motor mount 18 and the control head 16, for facilitating continuous, controlled orientation of the direction of thrust of the propeller 14 with respect to the boat 11. As shown in detailed perspective view in FIG. 2, the control wheel 25 comprises a hub 26 irrotatably affixed to the shaft 12 as by means of a set screw 27 passing therebetween and engaging the shaft 12 or by any other convenient means, including a tight frictional fit between the hub 26 and the shaft 12. An outer rim or band 28 having a serrated or notched upper engagement surface 29 is carried on a plurality of spokes 30 affixed to the hub 26. The serrations in the upper edge 29 enable the shoe or boot of a user to engage against the control wheel 25 without slipping for reorienting the motor 10 between any two rotational orientations.

In the first embodiment shown, the control wheel 25 is provided in two parts **25*a* and 25*b*, with the hub 26, rim 28, and spokes 30 formed in two substantially identical halves for clamping about the shaft 12 in an assembly plane as by means of clamping bolts 31. By such construction, the control wheel 25 may be fitted about the shaft 12 without disassembly of either the head 16 or the motor casing 13 and mount 18 from the shaft 12. The hub 26 is longer in axial length than the rim 28 in order that the control wheel assembly 25 may withstand substantial abuse or inadvertent applications of excess force upon the rim 28 by the pedal extremity (i.e. foot) of the user. The upward sweep to the spokes 30** strengthens the device and also gives it a pleasing appearance.

Where the control wheel 25 is to be used with a variety of motor shafts 12, either for sale of the devices for use on any of the commercially available tiller-model outboard trolling motors, or where any one purchaser of such a control wheel 25 would desire to use the control wheel with a variety of motors, as where he rents same at different marinas, a supply of shims 32 may be supplied with the wheel 25. The shims 32 adapt the inside diameter of the hub 26 of the wheel 25 to the outside diameter of any of the pivot shafts 12. As shown in FIG. 4, tightening the clamping bolts 31 at the assembly plane between the halves 25*a*, 25*b* of the wheel 25 also clamps the halves of the hub 26 onto the shaft 12 via any shims 32 provided. The set screw 27 may bear upon the shaft 12 directly or through the shim 32. Although the division of the control wheel 25 is here shown somewhat plainly in order to highlight the structure thereof, it will of course be understood that the vertical parting line between the halves of the control wheel 25 may be camouflaged as a matter of designers choice.

The control wheel in a second embodiment as either an add-on accessory to an outboard electric trolling motor or as original equipment is shown in FIG. 5. The control wheel 125 is constructed in one piece for sliding the hub 126 thereof over the end of the vertical shaft 12 of the outboard electric trolling motor 10. A set screw 127 affixes the hub 126 to the shaft 12 upwardly from the motor casing 13 and the motor mount, not shown. Spokes 130 connect the hub 126 to the rim 128. A rubber engagement member 129 is carried on the outside of the rim 128 for engagement by a control means such as a user's foot. The rubber member 129 may be ribbed transversely or circumferentially, as in FIG. 6, to increase the engagement effectiveness between it and such control means.

The one-piece control wheel of 125 of FIG. 5 can be used in the same manner as that shown in the views of FIGS. 2–4. However, it is also convenient to employ a reversible electric drive motor and gear reduction assembly 50 which turns a shaft 51 carrying a frictional drive wheel 52 thereon. The drive wheel 52 engages the member 129 of the control wheel 125 transversely thereto, in either a horizontal direction radial to the shaft 12 as shown in FIGS. 6 and 7, or in a vertical orientation parallel to the shaft 12, or otherwise as may be convenient, for rapid turning of the shaft 12. Where electric steering is used, the mounting bracket 18 will preferably allow the shaft 12 to rotate somewhat freely. Steering motor mounting means include a bracket 53, a mounting base 54, and a thumb screw 55 passing therebetween for obtaining proper alignment and engagement between the engagement wheel 52 and the rim 129.

The direction of rotation of the motor 50 for steering the outboard trolling motor 10 is controlled by a foot switch device 60 having switches 61 thereon for left and righ turning of the steering motor shaft 51. Such switches can also direct the speed of the propulsion motor 13. The control assembly 60 is conveniently mounted on a pedestal 62 adjacent a fishing seat 63 mounted in the bow of the boat 11. Cables 64 connect the control pedal 60 to the steering motor 50; power supply to the assembly is effected through a second power cable 65.

In operation, a fisherman owning a tiller model outboard electric trolling motor 10 may improve the convenience of use of same by applying a control wheel 25 or 125 to the shaft 12 thereof in accordance with the present invention. The control wheel 25, split into two halves 25*a* and 25*b*, is conveniently assembled about the shaft 12 employing any necessary shims 32 and passing the connecting bolts 31 between the assembly planes of halves 25*a* and 25*b*. Where the trolling motor 10 is conveniently disassembled, or where the control wheel 125 may be assembled with the motor 10 prior to assembly thereof, the hub 126 is slid over the shaft 12 from one end thereof. A set screw 27 is tightened between the hub 26 or 126 of the control wheel 25 or 125 and the shaft 12, to fix the control wheel 25 or 125 irrotatably with respect to the shaft 12 and the propulsion unit 13 and control unit 16 mounted thereon. The direction of thrust of the propeller 14 can be adjusted and readjusted by means of the user applying his pedal extremity (i.e. foot) to the engagement surface 29 or 129 of the control wheel 25 or 125, whereby precise and substantially instantaneous steering control may be obtained.

The control wheels 25 and 125 may be employed either in the manual mode of FIG. 1, or with an electric steering control 50 as in FIGS. 6 and 7. With proper adjustment of the mounting bracket 53 with respect to the base pedestal 54, the drive wheel 52 of the motor drive 50 engages against the surface 129 of the control wheel 125 for rotating same either clockwise or counterclockwise for reorienting the direction of thust of propeller 14 with respect to the boat 11. An operator of the boat seated in chair 63 can, by operating the buttons 61 on the control pedal 60, directly control the orientation of the propulsion motor 13.

By virtue of the present invention, there is provided a circumferentially extending action surface spaced radially outwardly of a rotational axis of the fishing motor and extending into an accessible location and by means of which a turning torque can be imparted to the shaft of the motor either manually by the operator or mechanically by means of a power assisting means.

Although various minor modifications may be suggested by those versed in the art, it should be understood that I wish to embody within the scope of the patent warranted hereon all such modifications as reasonably and properly come within the scope of my contribution to the art.

I claim as my invention:

1. A horizontal control wheel for steering an outboard electric trolling motor mountable on the bow of a boat, said motor having a vertical shaft pivotable about a vertical axis carrying on its lower end a propulsion motor and propeller, said control wheel comprising:

two symmetrical, joinable halves, each half comprising:

an outer band comprising substantially one-half of a perimeter of a circular control area, an inner hub surrounding substantially one-half of a circumference of said vertical shaft, said hub having two ends terminating in an assembly plane, said outer band and said hub each having a height defined by a top and a bottom, said height of said hub being greater than the height of said band, spoke means attached at a first end along the entire height of said hub and extending radially outwardly therefrom and attached at a second end to said band, said spoke means retaining said bottom of said band and said bottom of said hub in co-planar relation and descending from the top of said hub to the top of said band in arcuate fashion, said spoke means comprising separate parts attached respectively to said two ends of said hub and being disposed substantially 180° apart so as to lie completely in said assembly plane;

means for securing said halves together at said assembly planes including means clamping said inner hubs of each half in corotatable assembly with said vertical shaft and maintaining said assembly in spaced parallel relation and further maintaining said circular control area in 90° relation to said shaft and at least partially inboard of said boat, and said band carrying circumferentially extending action surface means extending inboard of the boat into an accessible position for frictional engagement by the pedal extremities of a boat operator, said circumferentially extending action surface means including frictional means to enhance said frictional engagement, whereby said operator can accurately selectively orient said motor in a rotationally continuous manner while permitting the free use of his hands.

2. In combination, a boat having a bow and a stern;

an outboard electric trolling motor having a vertical shaft pivotable about a vertical axis carrying on its lower end a propulsion motor and propeller;

a bow mounting means for attaching said outboard electric trolling motor to the bow of said boat;

a horizontal control wheel clampingly corotatably engaged about said vertical shaft of said outboard electric trolling motor, said control wheel engaging said vertical shaft at a distance above said bow of said boat, and extending inboard of said boat providing comfortable and unencumbered access to said control wheel by a pedal extremity of an operator of said boat standing near said bow of said boat;

said control wheel comprising:

two symmetrical, joinable halves, each half comprising:

an outer band comprising substantially one-half of a perimeter of a circular control area, an inner hub surrounding substantially one-half of a circumference of said vertical shaft, said hub having two ends terminating in an assembly plane, said outer band and said hub each having a height defined by a top and a bottom, said height of said hub being greater than the height of said band, spoke means attached at a first end along the entire height of said hub and extending radially outwardly therefrom and attached at a second end to said band, said spoke means retaining said bottom of said band and said bottom of said hub in co-planar relation and descending from the top of said hub to the top of said band in arcuate fashion, said spoke means comprising separate parts attached respectively to said two ends of said hub and being disposed substantially 180° apart so as to lie completely in said assembly plane;

means for securing said halves together at said assembly planes including means clamping said inner hubs of each half in corotatable assembly with said vertical shaft and maintaining said assembly in spaced parallel relation and further maintaining said circular control area in 90° relation to said shaft and at least partially inboard of said boat, and said band carrying circumferentially extending action surface means extending inboard of the boat into an accessible position for frictional engagement by the pedal extremities of a boat operator, said circumferentially extending action surface means including frictional means to enhance said frictional engagement, whereby said operator can accurately selectively orient said motor in a rotationally continuous manner while permitting the free use of his hands.

* * * * *